US005435898A

United States Patent [19]

Commander et al.

[11] Patent Number: 5,435,898

[45] Date of Patent: Jul. 25, 1995

[54] ALKALINE ZINC AND ZINC ALLOY ELECTROPLATING BATHS AND PROCESSES

[75] Inventors: John H. Commander, Old Saybrook; Victor J. Waldman, Milford, both of Conn.

[73] Assignee: Enthone-OMI Inc., West Haven, Conn.

[21] Appl. No.: 328,367

[22] Filed: Oct. 25, 1994

[51] Int. Cl.[6] ..... C25D 3/22; C25D 3/56

[52] U.S. Cl. ..... 205/245; 205/246; 205/309; 205/310; 106/1.05

[58] Field of Search ..... 205/309, 310, 245, 246; 106/1.05

[56] References Cited

U.S. PATENT DOCUMENTS

| | | | |
|---|---|---|---|
| 3,853,718 | 12/1974 | Creutz | 204/55 |
| 3,869,358 | 3/1975 | Nobel et al. | 204/55 |
| 3,884,774 | 5/1975 | Kessler | 204/55 |
| 3,957,595 | 5/1976 | DuBrow et al. | 205/309 |
| 4,022,676 | 5/1977 | Popescu | 205/310 |
| 4,081,336 | 3/1978 | Eppensteiner et al. | 205/310 |
| 4,113,583 | 9/1978 | Oshima et al. | 204/55 |
| 4,157,388 | 6/1979 | Christiansen | 424/70 |
| 4,169,771 | 10/1979 | Creutz et al. | 204/55 |
| 4,229,267 | 10/1980 | Steinecker | 205/310 |
| 4,444,629 | 4/1984 | Martin | 204/43 |
| 4,488,942 | 12/1984 | Martin et al. | 204/44 |
| 4,581,110 | 4/1986 | Tsuchida et al. | 204/44.2 |
| 4,730,022 | 3/1988 | Willis | 524/800 |
| 4,792,383 | 12/1988 | Willis | 204/55 |
| 4,923,575 | 5/1990 | Voss et al. | 204/44.2 |
| 4,983,263 | 1/1991 | Yasuda et al. | 204/44.2 |
| 5,182,006 | 1/1993 | Haydu et al. | 205/213 |
| 5,194,140 | 3/1993 | Dobrovolskis et al. | 205/245 |
| 5,296,159 | 3/1994 | Wilson et al. | 252/117 |

FOREIGN PATENT DOCUMENTS 26245 2/1979 Japan .

*Primary Examiner*—John Niebling
*Assistant Examiner*—Kishor Mayekar
*Attorney, Agent, or Firm*—DeLio & Peterson

[57] ABSTRACT

An aqueous bath for electrodepositing zinc and zinc alloys wherein the alloying metals are selected from the group consisting of iron, cobalt and nickel and containing an effective additive amount of a quaternary ammonium polymer to produce enhanced deposits. A process for electrodepositing zinc and zinc alloys using the baths of the invention is also disclosed.

23 Claims, No Drawings

ALKALINE ZINC AND ZINC ALLOY ELECTROPLATING BATHS AND PROCESSES

BACKGROUND OF THE INVENTION

1. Field of the Invention

The present invention relates to an electroplating bath and process for electrodepositing zinc and zinc alloys on a conductive substrate, and more particularly, to an electroplating bath and process incorporating controlled effective additive amounts of a bath soluble compatible quaternary ammonium polymer for enhancing the characteristics of the zinc or zinc alloy electrodeposit.

2. Description of Related Art

Considerable attention has been directed to the development of zinc electroplating baths which will produce zinc deposits of improved quality. For convenience, since zinc and zinc alloy baths are improved by this invention, the term zinc and zinc alloy may be used interchangeably with the application being directed to zinc-iron-cobalt alloys in particular.

Research has been devoted to improving zinc electroplating baths with regard to a number of plating properties such as over-all brightness, absence of pitting, providing of a uniform plating distribution thickness over a wide range of current densities, corrosion resistance, the capability of utilizing high zinc concentrations for increased efficiency, and the providing of a zinc alloy coating which is relatively uniform in composition over the article being plated as a base for further coatings such as a chromate coating.

Alkaline zinc plating baths are generally based on a solution of zinc ions and an excess of a base such as sodium hydroxide and water. High pH alkaline zinc baths however, when used without brightening or addition agents yield deposits which are rough and spongy and are generally unacceptable for most applications.

Zinc electroplating has been conducted in plating baths employing alkali metal cyanide salts which serve in such baths as an additive or complexing agent to achieve the desired plating operation and produce bright, smooth grained zinc deposits. Because of the toxicity of cyanides and environmental considerations however, it is desirable to provide in addition to cyanide baths, plating baths which operate effectively at low cyanide levels or advantageously in the total absence of cyanide salts.

Zinc and zinc alloy electroplating baths of various types have been used in depositing a metal plating of a decorative or functional type on a variety of conductive substrates such as iron and steel to provide for improved corrosion resistance and to enhance the decorative appearance of the article. Typically, zinc and alloys of zinc and nickel, iron and cobalt and mixtures thereof have been used to provide decorative surface finishes while enhancing the resistance of the substrate to corrosion. In many cases, the zinc electroplating coatings are subject to additional corrosion treatments such as a chromate treatment but the composition of the alloy deposited must be uniform over the plated article or the chromate coating will not be satisfactory.

In electroplating processes for example, it is technically difficult to maintain a uniform current density over the whole surface of an article to be plated. Articles having projected portions and recessed portions have a different current density on the projected portion than on the recessed portion and it is difficult to obtain a substantially equal current density on these two portions. The variability of the current density over the article being plated affects the thickness of the plating and uniformity of the alloy components in the coating. This subsequently affects the nature of the chromate coating which may be a bright chromate, a colored chromate, a black chromate, a green chromate, etc. to provide a high corrosion resistant article. A highly desirable bath provides uniform alloy composition deposits and deposits wherein the ratio of the thickness of the deposit as measured at, e.g., 80 amps/ft (ASF) to the thickness of the deposit as measured at 4 ASF approaches 1 with 1 being the ideal thickness ratio since at this ratio the thickness of an article having projected and recessed portions would be the same over the complete article.

It is also important that the zinc plating bath be operable in manual and automatic rack and barrel plating operations and that the chromate conversion coating on the zinc electroplate likewise be operable in manual and automatic rack operations and barrel operations. The chromate coating should be uniform with virtually no iridescence for black chromates.

A number of patents have issued over the years disclosing improved zinc electroplating baths containing specific brightening agents including: U.S. Pat. Nos. 3,853,718; 3,869,358; 3,884,774; 4,113,583; 4,169,771; 4,229,267; 4,730,022; 4,792,038; 5,182,006 and 5,194,140. These baths are generally deficient for a number of reasons.

Bearing in mind the problems and deficiencies of the prior art, it is therefore an object of the present invention to provide an alkaline, zinc or zinc alloy electroplating bath which produces bright substantially pit-free zinc and zinc alloy deposits.

Another object of the present invention is to provide an alkaline zinc or zinc alloy electroplating bath which substantially improves the uniformity of the thickness and/or of the uniformity of the alloy components in the plating over a wide range of current densities.

A further object of the present invention is to provide an alkaline zinc or zinc alloy electroplating bath which provides commercially satisfactory zinc and zinc alloy coatings in rack and barrel plating operations.

Another object of the present invention is to provide an alkaline zinc or zinc alloy electroplating bath which provides a zinc or zinc alloy coating which may be chromated producing a full uniform chromate coating coverage with virtually no iridescence when black chromating.

Another object of the invention is to provide an alkaline zinc or zinc alloy electroplating bath which may contain a wide range of zinc concentration levels for different plating operations.

Another object of the present invention is to provide a method to zinc or zinc alloy electroplate substrates using the baths of the invention.

Other objects and advantages will be apparent from the following description.

SUMMARY OF THE INVENTION

It has now been discovered that the objects and advantages of the present invention are achieved by using an aqueous alkaline zinc electroplating bath and/or alkaline zinc alloy electroplating bath containing an effective additive amount of a quaternary ammonium polymer of the formula:

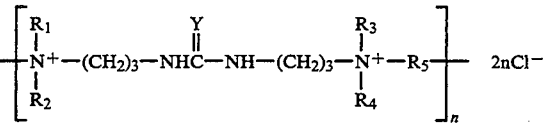

wherein Y is selected from the group consisting of S and O; n is at least 1; $R_1$, $R_2$, $R_3$ and $R_4$ may be the same or different and are selected from the group consisting of methyl, ethyl, isopropyl, 2-hydroxyethyl and—$CH_2CH_2(OCCH_2CH_2)_xOH$ wherein X may be 0 to 6; and $R_5$ is selected from the group consisting of $(CH_2)_2$—O—$(CH_2)_2$; $(CH_2)_2$—O—$(CH_2)_2$—O—$(CH_2)_2$ and $CH_2$—CHOH—$CH_2$—O—$CH_2$—CHOH—$CH_2$.

The preferred polymer because of its demonstrated effectiveness is MIRAPOL®WT, CAS No. 68555-36-2, and which is sold by Rhone-Poulenc. This polymer has an average molecular weight of 2200, n=6 (average), Y=O, $R_1$–$R_4$ are all methyl and $R_5$ is $(CH_2)_2$—O—$(CH_2)_2$. The formula may be represented as follows:

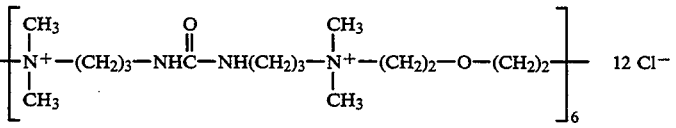

The molecular weight of the ammonium polymer additive is not believed to be critical. The polymer must be bath soluble which sets a functional upper limit of molecular weight or degree of polymerization. Thus, the molecular weight of the polymer additive can vary up to a molecular weight at which the brightener becomes bath insoluble.

The improved baths have certain advantages over the baths of the prior art depending on the components used and their concentrations. For example, substantially pit-free coatings having a high degree of brightness (grain refinement) may be obtained. Relatively uniform plating may be performed over a wide range of current densities enabling the plating of complex shapes and lengths having both high and low current density areas and in a variety of plating modes such as manual and automatic rack or barrel operations. Plated articles which are to be further treated by chromating or other protective coatings may also be substantially improved with uniform full chromate coating coverage with virtually no iridescence upon black chromating. Chromating may likewise be performed in manual and automatic rack operations and barrel operations. The plating bath may also contain a wide range of zinc concentration levels which enables it to be used effectively and efficiently at both low and high current densities.

DESCRIPTION OF THE PREFERRED EMBODIMENTS

Alkaline zinc electroplating baths both cyanide-containing and cyanide-free are well known in the art and have been commonly used for years. The basic alkaline zinc electroplating bath contains a zinc compound and an alkali hydroxide. The zinc salt may be any soluble salt and is usually zinc oxide and the base sodium hydroxide and the predominate zinc species in the bath at high pH ranges is believed to be the zincate ion. It will be appreciated that as used herein, the term "zinc ion" includes zincate or other ionic species of zinc useful in electroplating baths for electroplating metallic zinc and zinc alloys therefrom. With regard to a zinc alloy electroplating bath the basic zinc bath further contains metals such as nickel, cobalt and iron and combinations thereof to provide alloys of zinc and nickel; zinc and cobalt; zinc, nickel and cobalt; zinc and iron; zinc, iron and nickel; and zinc iron and cobalt. A particularly preferred zinc alloy is a zinc-iron-cobalt alloy.

Iron can be introduced into the aqueous bath solution in the form of aqueous soluble iron salts such as iron sulfate, iron chloride, iron fluoborate and the like or mixtures thereof. The cobalt and nickel ions similarly can be introduced as salts, such as the sulfate, chloride, etc. In a preferred electroplating bath of the invention which produces a zinc-iron-cobalt coating, the zinc source is zinc oxide, the alkali hydroxide is sodium hydroxide, the iron salt is ferrous sulfate and the cobalt salt is cobalt (II) sulfate.

The content of the zinc compound is generally about 5 to 25 g/l and up to 200 g/l, e.g., 100 g/l, or more, and is preferably about 5 to 20 g/l. The alkaline hydroxide is generally about 75 g/l to 500 g/l, e.g., 300 g/l, or more, and is preferably 90 to 150 g/l. The iron calculated as iron is up to about 500 mg/l or more, preferably about 30 to about 120 mg/l and the cobalt calculated as cobalt is up to 500 mg/l or more, preferably about 30 to about 120 mg/l. Nickel is generally 1 to 6 g/l.

Depending upon the purpose for which the electroplating is carried out, the zinc bath can be used in widely different concentration ranges. For example, where increased throwing power is important, the desirable zinc concentration is about 5 to 10, preferably 6 to 8 g/l and about 90 to 135 g/l for the alkali hydroxide. When the current efficiency and operability are important factors such as in barrel plating, the desired concentration of zinc is about 12 to 17 g/l and 120 to 150 g/l alkali hydroxide.

In zinc alloy baths it is important that the metal ions in appropriate amounts and in appropriate form be present in the bath. One preferred way is to use a chelating agent in the bath in an effective amount to maintain the metals in the bath in solution, e.g., to dissolve the required amount of iron and other alloy ingredients in the bath. The chelating agent used herein should complex the metal ions to an electrodepositable extent in a strong alkalinity of a pH of above 13 and thus permit their stable dissolution. This should also not adversely affect the plating. Levels of about 10–150 g/l or more may be employed and it has been found that levels of above about 50 g/l, preferably 60–100 g/l are important for zinc baths for barrel plating to obtain a zinc coating providing uniform black chromate coatings.

Examples of suitable chelating agents include hydroxy carboxylic acids salts such as citrates, tartrates, gluconates and glycollates; amino alcohols such as monoethanolamine, diethanolamine and triethanolamine; polyamines such as ethylenediamine; amino carboxylic acid salts such as ethylenediamine tetraacetates and nitrilotriacetates; polyhydroxy alcohols such as sorbitol, and thioureas. They may be used singly or in combination. Gluconates are the preferred chelating agent, especially the sodium salt.

The plating bath of this invention may contain additives of the type conventionally employed in alkaline zinc electroplating baths and includes such materials as brightening agents, such as aldehydes, grain refiners such as polyamines, gelatin, glues, peptone and polyvinyl alcohols. Illustrative of such other additives are p-methoxy benzaldehyde, heliotropine and vanillin. Vanillin is a preferred additive in the plating bath of the invention. Typically, aldehyde additives will range from about 1 to about 80 mg/l or more and preferably about 3 to about 50 mg/l.

An essential aspect of the invention is the discovery that a particular class of cationic polymers provide enhanced plating and other operational benefits when used in all types of zinc and zinc alloy plating baths including conventional zinc and zinc alloy baths. The preferred polymers are represented by the formula:

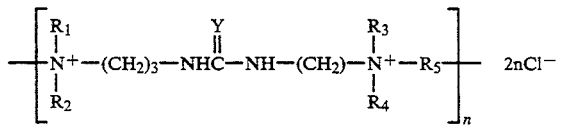

wherein Y is selected from the group consisting of S and O; n is at least 1; $R_1$, $R_2$, $R_3$ and $R_4$ may be the same or different and are selected from the group consisting of methyl, ethyl, isopropyl, 2-hydroxyethyl and—$CH_2CH_2(OCCH_2CH_2)_xOH$ wherein X may be 0 to 6; and $R_5$ is selected from the group consisting of $(CH_2)_2$—O—$(CH_2)_2$; $(CH_2)_2$—O—$(CH_2)_2$—O—$(CH_2)_2$ and $CH_2$—CHOH—$CH_2$—O—$CH_2$—CHOH—$CH_2$.

The preferred polymer because of its demonstrated effectiveness is MIRAPOL ®WT, CAS No. 68555-36-2. This polymer has an average molecular weight of 2200; n=6 (average), Y=O, $R_1$–$R_4$ are all methyl and $R_5$ is $(CH_2)_2$—O—$CH_2)_2$. MIRAPOL ®WT, the preferred polymer, is chemically poly [N-[-3-(dimethylamino) propyl]-N'-[3-(ethyleneoxyethylene dimethylammonio) propyl]urea dichloride].

The quaternary ammonium polymers and their method of preparation are disclosed in U.S. Pat. No. 4,157,388 to A. Christiansen, which patent is hereby incorporated by reference. As shown in the patent, a ditertiaryamine monomer of formula II is condensed with a monomer dihalide (B) to form the polymer. Molecular weights of about 2,000 to 40,000 have been obtained but they may be as low as 350 or as high as 100,000. The polymer is used herein by employing it in amounts up to about 10 g/l or more, preferably about 0.5 to 3 g/l in the bath, and more, preferably about 1 to 1.5 g/l. Preferably the polymer is dissolved in water at a concentration of about 50 to 300 g/l, e.g., 240 g/land an appropriate amount used to make up the bath.

Another class of quaternary ammonium polymers is represented by MIRAPOL ® AD-1 which is identified by CAS No. 90624-75-2. This polymer has the formula:

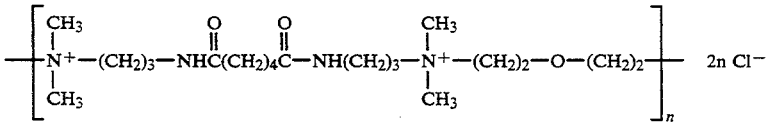

This polymer has an average molecular weight of about 50,000 and n=100 (average). The methyl groups and the—$(CH_2)_2$—O—$(CH_2)_2$—group correspond to $R_1$–$R_4$ and $R_5$ of the general formula for MIRAPOL WT above. $R_1$–$R_5$ for MIRAPOL AD-1 is as defined for MIRAPOL ®WT.

The electroplating of zinc and zinc alloys conducted in accordance with the process of this invention is effected in conventional fashion basically by passing a direct current from an anode through the aqueous alkaline bath to the desired cathode article which is be electroplated with the zinc or zinc alloy. The process may be conducted at a temperature of from about 10° to about 100° C. typically about 15° to about 45° C. The current densities employed may range up to about 200 amperes per square foot (ASF) or more with a preferred range of about 1 to 120 ASF being satisfactory for most plating operations. A wide range of plating operations can be used such as rack plating and barrel plating. Other plating methods include a continuous (reel to reel) method.

In order to further illustrate the composition and process of the present invention, the following examples are provided. It will be understood that the examples are provided for illustrative purposes and are not intended to be limiting of the scope of the present invention as herein described and is set forth in the claims.

EXAMPLE 1

An aqueous electrolyte suitable for plating a zinc-iron-cobalt alloy was prepared containing 7.5 g/l zinc oxide, 105 g/l NaOH, 25 g/l sodium gluconate, 75 mg/l cobalt as the metal (supplied as cobalt (II) sulfate), 50 mg/l iron as the metal (supplied as ferrous sulfate), and 1.4 g/l MIRAPOL ®WT (supplied as a 240 g/l aqueous solution). 6-2.5 inch×4 inch steel panels were plated at 21 ASF for 20 minutes at room temperature. The panels were then rinsed and chromated in a black chromating bath containing chromic acid, sulfuric acid, phosphoric acid and inorganic salts by immersion at room temperature.

The chromated panels had a slight iridescence and were commercially satisfactory. Comparison runs using a commercial bath containing an imidazolepichlorohydrin copolymer+a polyamide produced panels which were not commercially satisfactory and had significantly more iridescence.

EXAMPLE 2-3

The aqueous electrolyte of Example 1 was used to plate steel panels at 2 amperes in a Hull Cell (Example 2). Another electrolyte containing the same materials except the zinc oxide is 15 g/l and the sodium hydroxide is 142.5 g/l was prepared as Example 3. A Hull Cell provides a different current density over the length of a single panel which enables plating thickness measurements over the range of current densities. The following results were obtained for room temperature plating over a 30 minute period:

| BATH | PLATING THICKNESS ($10^{-6}$ inch) CURRENT DENSITY (ASF) 80 | 60 | 40 | 20 | 4 | RATIO 80/4 |
|---|---|---|---|---|---|---|
| EXAMPLE 2 | 281 | 286 | 276 | 235 | 171 | 1.75 |
| EXAMPLE 3 | 597 | 573 | 488 | 409 | 208 | 2.9 |
| Commercial Bath* | 542 | 480 | 438 | 309 | 149 | 3.6 |

*Commercial bath of Example 1

EXAMPLE 4

An aqueous electrolyte suitable for plating a zinc-iron-cobalt alloy was prepared containing 15 g/l zinc oxide, 139.5 g/l NaOH, 63 mg/l iron as the metal (supplied as ferrous sulfate), 48 mg/l cobalt as the metal (supplied as cobalt sulfate), 25 g/l sodium gluconate and 1.5 g/l MIRAPOL ®WT (supplied as a 240 g/l aqueous solution).

Six panels were plated and chromated as in Example 1. Three chromated panels were also heat treated at 120° C. for 1 hour. Six panels were plated and chromated as in Example 1 using the commercial bath. The panels were tested for corrosion by neutral salt fog test, ASTM B-117.

The heat treated panels prepared using the commercial bath exhibited white corrosion between 96–168 hours and red corrosion between 120–330 hours. The heat treated panels prepared according to the invention showed no significant white or red corrosion to 744 hours. No significant corrosion was noted for the non-heat-treated panels.

EXAMPLES 5

An aqueous electrolyte suitable for plating a zinc-iron-cobalt alloy was prepared containing 15 g/l zinc oxide, 135 g/l NaOH, 75 g/l sodium gluconate, 66 mg/l iron, 50 mg/l cobalt, 40 mg/l vanillin and 1.0 g/l MIRAPOL ®WT (supplied as a 240 g/l aqueous solution). Steel fasteners were plated in a barrel (8.5×12 inch) at 1–10 ASF and room temperature.

Excellent plating and chromate blackening results were obtained. Lower levels of sodium gluconate (25 g/l and 50 g/l) did not produce the same plating and blackening results.

This example demonstrates the need to have higher levels of complexing agent in zinc containing barrel plating baths.

EXAMPLE 6

An aqueous electrolyte suitable for plating a zinc-iron cobalt alloy was prepared containing 7.5 g/l zinc oxide, 135 g/l NaOH, 50 g/l sodium gluconate, 50 mg/l cobalt, 80 mg/l iron, 1.5 g/l MIRAPOL ®WT and 40 mg/l vanillin. Small steel fasteners were barrel plated under the following commercial conditions: 36 inch barrel, 100 pound load, 150 gal. bath size and 1–10 ASF at room temperature.

Excellent zinc plating and glossy black blister free chromate coatings were obtained by barrel chromating. Similar results were obtained over a 1000 pound load run.

It will thus be seen that the objects set forth above, among those made apparent from the preceding description, are efficiently attained and, since certain changes may be made in the above compositions and processes without departing from the spirit and scope of the invention, it is intended that all matter contained in the above description shall be interpreted as illustrative and not in a limiting sense.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. An aqueous alkaline bath suitable for electrodepositing zinc and zinc alloys comprising a source of zinc ions in an amount to electrodeposit zinc, and in the case of the alloy, a source of additional metal ions selected from the group consisting of nickel, cobalt, iron or mixtures thereof present in amount of electrodeposit zinc alloys, and an effective additive amount of a bath soluble polymer of the formula:

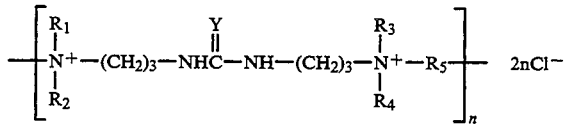

wherein Y is selected from the group consisting of S and O; n is at least 1; $R_1$, $R_2$, $R_3$ and $R_4$ may be the same or different and are selected from the group consisting of methyl, ethyl, isopropyl, 2-hydroxyethyl and—$CH_2CH_2(OCCH_2CH_2)_xOH$ wherein X may be 0 to 6; and $R_5$ is selected from the group consisting of $(CH_2)_2$—O—$(CH_2)_2$; $(CH_2)_2$—O—$(CH_2)_2$—O—$(CH_2)_2$ and $CH_2$—CHOH—$CH_2$—O—$CH_2$—CHOH—$CH_2$.

2. The bath of claim 1 wherein the zinc ion is present in the form of zinc salts in an amount of about 5 to 25 g/l.

3. The bath of claim 2 wherein the alkalinity is provided by sodium hydroxide in an amount of about 75 to 200 g/l.

4. The bath of claim 3 wherein said additive is present in an amount of about 0.5 to 3 g/l.

5. The bath of claim 4 wherein said additive is present in an amount of about 1 to 1.5 g/l.

6. The bath of claim 1 wherein the additive is defined by $R_1$, $R_2$, $R_3$ and $R_4$ are methyl, Y=O, $R_5=(CH_2)_2$—O—$(CH_2)_2$.

7. The bath of claim 6 wherein n is an average of about 6.

8. The bath of claim 7 further contains an effective amount of vanillin.

9. The bath of claim 1 wherein the metal ions are cobalt and iron and the alloy produced is a zinc, iron and cobalt alloy.

10. The bath of claim 9 wherein the zinc ion is present in the form of zinc salts in an amount of about 5 to 25 g/l, the iron is about 30 to 120 ml and the cobalt is about 30 to 120 mg/l.

11. The bath of claim 10 wherein the alkalinity is provided by sodium hydroxide in an amount of about 75 to 200 g/l.

12. The bath of claim 9 wherein the additive is present in an amount of about 0.5 to 3 g/l.

13. The bath of claim 11 wherein the additive is present in an amount of about to 1.5 g/l.

14. The bath of claim 9 wherein the additive is defined by $R_1$, $R_2$, $R_3$ and $R_4$ are methyl, Y=O, $R_5=(CH_2)_2$—O—$(CH_2)_2$.

15. The bath of claim 14 wherein n is an average of about 6.

16. The bath of claim 12 wherein the additive is defined by $R_1$, $R_2$, $R_3$ and $R_4$ are methyl, Y=O, $R_5=(CH_2)_2—O—(CH_2)_2$.

17. The bath of claim 16 wherein n is an average of about 6.

18. A process for electrodepositing zinc and zinc alloys on a conductive substrate which comprises contacting the substrate with an aqueous alkaline bath as defined in claim 1 and electrodepositing zinc or zinc alloy on the substrate.

19. A process for electrodepositing zinc and zinc alloys on a conductive substrate which comprises contacting the substrate with an aqueous alkaline bath as defined in claim 6 and electrodepositing zinc or zinc alloy on the substrate.

20. A process for electrodepositing zinc and zinc alloys on a conductive substrate which comprises contacting the substrate with an aqueous alkaline bath as defined in claim 9 and electrodepositing zinc or zinc alloy on the substrate.

21. A process for electrodepositing zinc and zinc alloys on a conductive substrate which comprises contacting the substrate with an aqueous alkaline bath as defined in claim 14 and electrodepositing zinc or zinc alloy on the substrate.

22. An aqueous alkaline bath suitable for electrodepositing zinc and zinc alloys comprising a source of zinc ions in an amount to electrodeposit zinc, and in the case of zinc alloys, a source of additional metal ions selected from the group consisting of nickel, cobalt and iron present in an amount to electro deposit an alloy of zinc and nickel; zinc and cobalt; zinc, nickel and cobalt; zinc and iron; zinc, iron and nickel; zinc, iron and cobalt; and an effective additive amount of a bath soluble polymer of the formula:

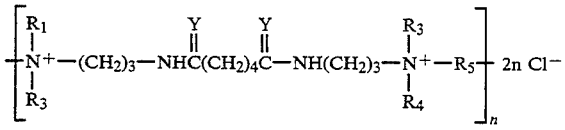

wherein Y is selected from the group consisting of S and O; n is at least 1; $R_1$, $R_2$, $R_3$ and $R_4$ may be the same or different and are selected from the group consisting of methyl, ethyl, isopropyl, 2-hydroxyethyl and—$CH_2CH_2(OCCH_2CH_2)_xOH$ wherein X may be 0 to 6; and $R_5$ is selected from the group consisting of $(CH_2)_2—O—(CH_2)_2$; $(CH_2)_2—O—(CH_2)_2—O—(CH_2)_2$ and $CH_2—CHOH—CH_2—O—CH_2—CHOH—CH_2$.

23. The bath of claim 22 wherein the polymer is defined by $R_1$, $R_2$, $R_3$ and $R_4$ are methyl, Y=O, $R_5=(CH_2)_2—O—(CH_2)_2$ and n is an average of about 100.

* * * * *